United States Patent [19]

Tsukamoto

[11] 4,060,209

[45] Nov. 29, 1977

[54] COIL HOLDING DEVICE

[76] Inventor: Kotaro Tsukamoto, 7-8 Kashima, 4-Block, Yodogawa, Osaka, Osaka, Japan

[21] Appl. No.: 694,798

[22] Filed: June 10, 1976

[51] Int. Cl.[2] ..... B65H 49/26; B21C 47/20

[52] U.S. Cl. ..... 242/54 R; 242/79; 242/117; 242/129

[58] Field of Search ..... 242/117, 129, 79, 78, 242/84, 81, 54 R, 131, 131.1, 25 R

[56] References Cited

U.S. PATENT DOCUMENTS 1,408,463 3/1922 Miles ..... 242/117

2,424,307 7/1947 Dunbar ..... 242/117 X

*Primary Examiner*—George F. Mautz

*Attorney, Agent, or Firm*—Wenderoth, Lind & Ponack

[57] ABSTRACT

A coil holding device which has a bed plate with an upright support situated thereon. To the upright support are rotatably mounted a pair of rotary drums which are designed to hold two coils thereon. Each of the drums has a spiral groove around the circumference thereof, this spiral being inverse to the rotary direction of the drums. Further, the drum may be conically tapered toward the upright support and may have a plurality of longitudinal grooves along the sides thereof from the outer end toward the upright support.

4 Claims, 3 Drawing Figures

COIL HOLDING DEVICE

BACKGROUND AND SUMMARY OF THE PRESENT INVENTION

The present invention pertains to a holding device for a coil of long wire so that the coil can be easily and smoothly fed to an elongating or drawing machine.

The conventional holding device of the same type as the present invention contains a coil mounting drum set in a horizontal and free-rotating condition, and this drum is fitted with a circular plate on its outside which has a larger diameter than the drum itself so that the coil is prevented from slipping off during the course of feeding. According to this old system, however, each time a new material coil, brought by crane or the like, is mounted on the drum, the circle plate must be detached and reattached at the cost of extra labor and much inconvenience.

The primary object of the present invention is to alleviate this shortcoming of the existing holding device and offer instead a coil holding a device which assures troublefree coil mounting.

The second object is to offer a device for preventing the material coil on the drum from slipping off due to rotations of the drum in the course of feeding by means of a spiral groove cut out around the drum.

The third object is to offer a coil holding device which assures perfect working of the aforementioned spiral groove because of the shape of the drum which is tapered down towards the drum supporter.

The fourth object is to offer the coil holding device, which prevents the coil lifting hook from getting caught between the coil and drum, and makes it hard to remove. For this purpose, straight, concave grooves are prepared longitudinally on the drum.

BRIEF DESCRIPTION OF THE DRAWINGS

These objects can be achieved through the improvements performed by the component parts of the present invention, which will be made clear by the attached drawing of the preferred embodiment and by the explanations described hereunder in detail.

In the drawings.

DETAILED DESCRIPTION OF THE INVENTION

Figure 1:
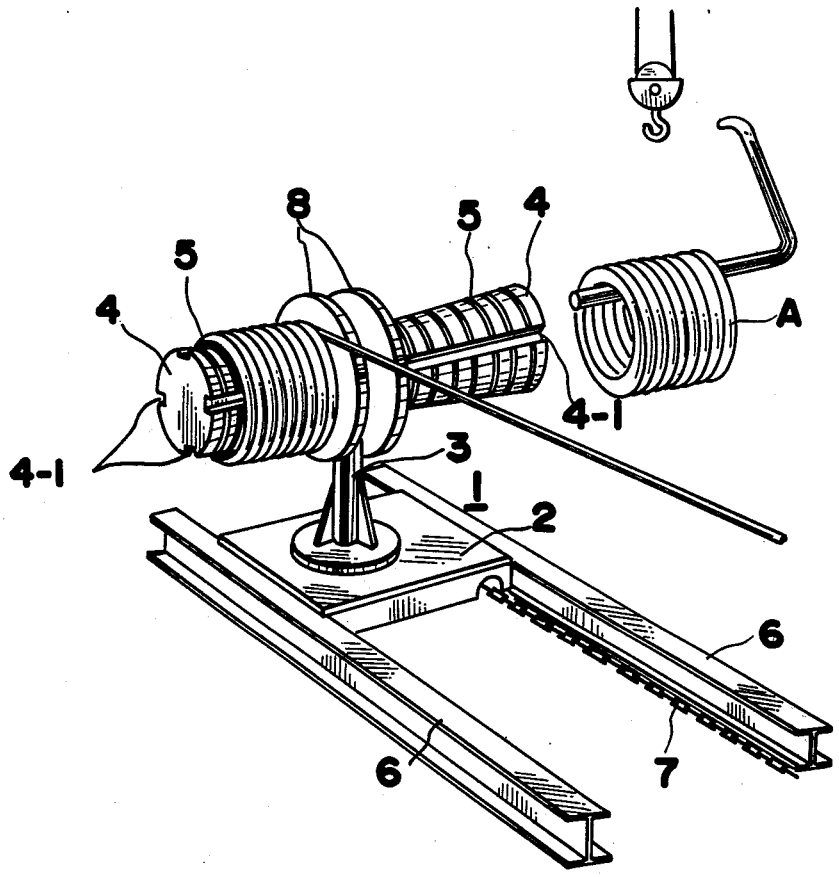
FIG. 1 is a perspective view of the coil holding device pertaining to the present invention.
Figure 2:
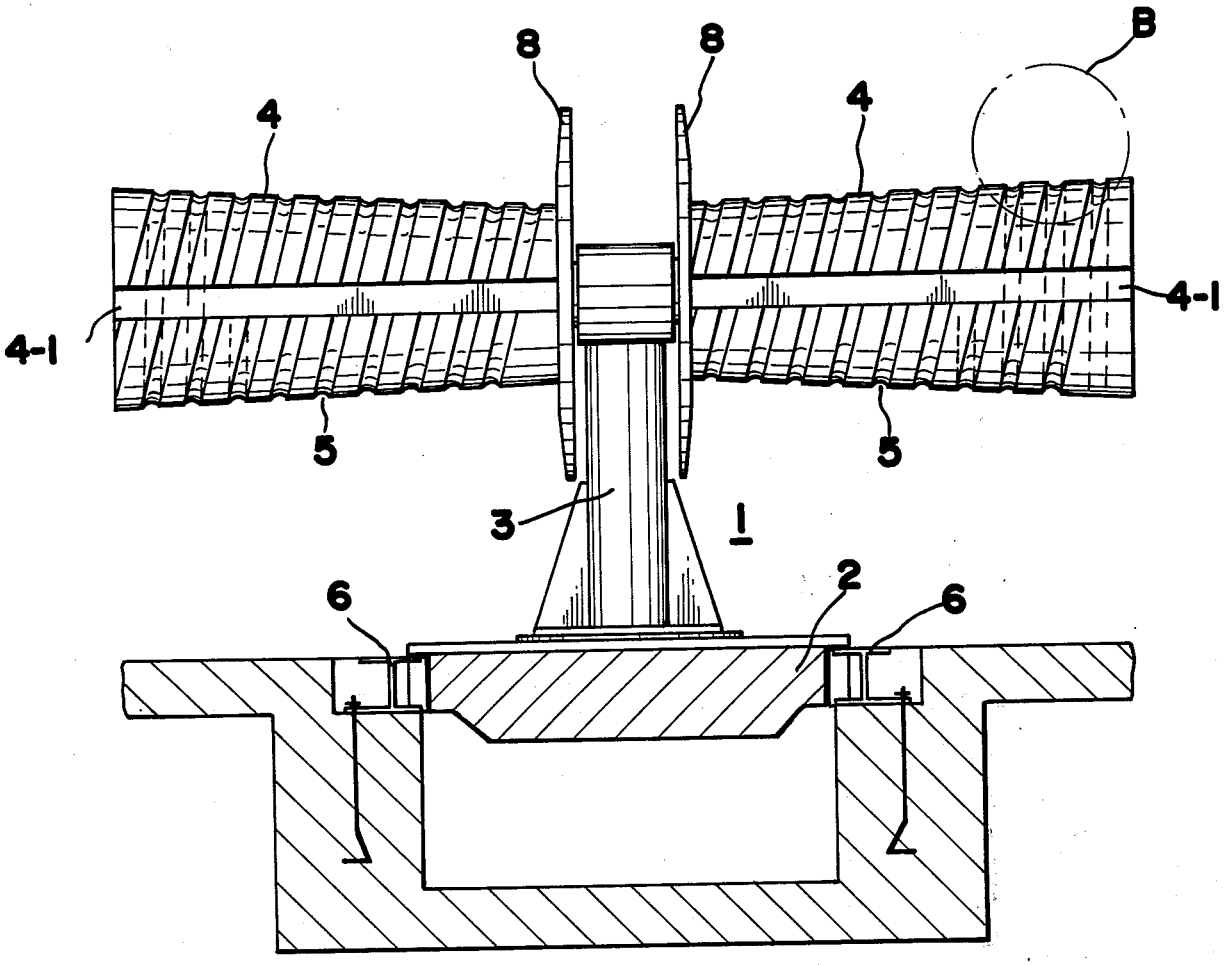
FIG. 2 is the front view of the said device.
Figure 3:
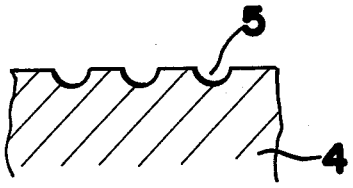
FIG. 3 is the magnified drawings of the circled portion B in FIG. 2.

To explain about the present invention according to the drawings, FIG. 1 shows the coil holding device having a rotary drum 4 set upon the supporter 3 erected on the bed plate 2 for mounting the material coil A. Around the surface of the aforementioned drum 4 is a spiral groove 5 which runs inversely to the rotary direction of the drum, i.e. the spiral groove 5 which runs towards the supporter 3 with the rotary movement of the drum. The drum 4 has a conical shape so that it is tapered as it nears the supporter 3, and has straight, concave grooves 4-1 along the longitudinal direction thereof. The bed plate 2 of the device in FIG. 1 is operated on rails 6,6 and may be moved forward or backward by a chain 7 which is driven by a reversible motor, thereby simplifying setting the material coil on the elongating equipment, etc. The inside circular plates 8,8 prevent the material coil A from dropping down on the side of the supporter 3 when set on the drum 4.

Next, based on the structural arrangement of the invention described above are explanations of the performance and effect of the invention according to the example of practical employment shown in the drawings.

When the material coil A on the drum 4 is set on the elongating machine (no drawing furnished) and drawn out, the force of this drawing causes the drum 4 to begin to turn and the material wire in the coil drops into the spiral groove 5.

Due to this turning or rotation of the drum, the groove 5 tries to run into the internal direction, that is, tries to approach the supporter 3, and even though the material coil on the drum tries to expand to go out as the rotary speed is quickened, it is kept in the groove for smooth and perfect feeding constantly without falling down outside.

As explained above, according to the coil holding device of the present invention, on the outside of the coil mounting drum on which the spiral groove is formed inversely from the rotary direction of the drum so that it moves towards the supporter as the drum turns around, at the time of the feeding operation, the material wire is led into the internal direction, i.e. towards the supporter side, by the spiral groove as the drum turns. Therefore, establishment of an outside circular plate onto the drum for preventing the wire material from falling off, as in the conventional devices, is no longer required, and the work of mounting the material coil on the drum is extremely simplified.

Also, as is shown by the example of actual employment, with the drum arranged in a conical shape tapered towards the internal direction, i.e. down to the supporter's side, the effect of preventing the material coil from falling out is further improved and the straight grooves, concaved longitudinally on the drum, facilitate the insertion therein of the lifting hook from its open end for mounting the material coil on the drum. After it is mounted, the hook can be easily released.

For actual operation, a pair of the drums 4,4 are set on the supporter 3 in such a way as to slew horizontally, as shown in the example. This arrangement is aligned so that while the material coil on one drum is in the process of feeding, another material coil can be mounted on the other drum 4. Therefore, when the feeding of the forerunning material is completed, the drums 4,4 are slewed by 180° horizontally to start the feeding operation again.

What is claimed by the present invention is not intended to be limited only to the work shown by the concrete example quoted above, but includes also variations and revisions within the scope of this disclosure.

What is claimed is:

1. A coil holding device comprising:

a bed plate;

an upright support on said bed plate; and a pair of rotary drum means mounted on said upright support above said bed plate for rotatably holding two of said coils thereon, each drum means having a spiral groove around the circumference thereof, said spiral being inverse to the rotary direction of said drum means, whereby said spiral groove moves toward said support as said rotary drum means rotates.

2. A device as claimed in claim 1 wherein each rotary drum means is conically shaped and tapered toward said upright support.

3. A device as claimed in claim 1 wherein each rotary drum means has a plurality of longitudinal grooves along the side thereof from the outer end toward said upright support.

4. A device as claimed in claim 1 further comprisng a pair of circular plate means, one plate means on each drum means next to said upright support for preventing said coils on said rotary drum means from contacting said upright support.

* * * * *